US008746684B2

(12) United States Patent
Okano et al.

(10) Patent No.: US 8,746,684 B2
(45) Date of Patent: Jun. 10, 2014

(54) IMAGE FORMING APPARATUS

(75) Inventors: Tadashi Okano, Kanagawa (JP); Eiji Tachibana, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 61 days.

(21) Appl. No.: 13/527,737

(22) Filed: Jun. 20, 2012

(65) Prior Publication Data

US 2013/0001850 A1 Jan. 3, 2013

(30) Foreign Application Priority Data

Jun. 29, 2011 (JP) ..... 2011-143996

(51) Int. Cl.
*B65H 1/00* (2006.01)

(52) U.S. Cl.
USPC ..... 271/171; 271/145; 271/164

(58) Field of Classification Search
USPC ..... 271/145, 171, 162, 163, 164
See application file for complete search history.

(56) References Cited

U.S. PATENT DOCUMENTS

| | | | | |
|---|---|---|---|---|
| 5,692,231 | A * | 11/1997 | O et al. | 399/23 |
| 5,895,041 | A * | 4/1999 | Nishimura | 271/171 |
| 7,070,350 | B2 * | 7/2006 | Inokuchi et al. | 400/680 |
| 7,277,199 | B2 * | 10/2007 | Swayze et al. | 358/1.9 |
| 7,322,763 | B2 * | 1/2008 | Yang | 400/624 |
| 7,862,037 | B2 * | 1/2011 | Kunioka | 271/171 |
| 8,272,637 | B2 * | 9/2012 | Asada et al. | 271/171 |
| 2009/0206539 | A1 * | 8/2009 | Takeuchi et al. | 271/3.14 |
| 2011/0216137 | A1 | 9/2011 | Okano | |
| 2011/0222799 | A1 | 9/2011 | Wang | |

FOREIGN PATENT DOCUMENTS

| | | |
|---|---|---|
| JP | 5-69957 | 3/1993 |
| JP | 7-133050 | 5/1995 |
| JP | 2009-40549 | 2/2009 |
| JP | 2010-6592 | 1/2010 |

* cited by examiner

*Primary Examiner* — Ernesto Suarez
(74) *Attorney, Agent, or Firm* — Cooper & Dunham LLP

(57) ABSTRACT

An image forming apparatus including a sheet feed cassette to hold a stack of recording media, a cover detachably attachable to the sheet feed cassette to cover an opening of the sheet feed cassette through which the recording media are supplied, an image forming part to form images on the recording media, and a discharge tray having a top surface on which the recording media discharged from the image forming apparatus after image formation are stacked. The sheet feed cassette is disposed below the discharge tray and is contractibly extendable, protruding outwardly from the image forming apparatus to accommodate large-sized recording media in its extended state. The cover includes a displaceable discharge auxiliary member slidable against the cover so as to be flush with the top surface of the discharge tray and detachably attachable to the sheet feed cassette together with the cover.

10 Claims, 13 Drawing Sheets

IMAGE FORMING APPARATUS

CROSS-REFERENCE TO RELATED APPLICATION

The present patent application is based on and claims priority pursuant to 35 U.S.C. §119 from Japanese Patent Application No. 2011-143996, filed on Jun. 29, 2011 in the Japan Patent Office, which is incorporated by reference herein in its entirety.

BACKGROUND OF THE INVENTION

1. Field of the Invention

Exemplary aspects of the present invention generally relate to an image forming apparatus including a sheet feed cassette, a form of which is changeable to accommodate recording media in a variety of sizes.

2. Description of the Related Art

In image forming apparatuses such as printers, copiers, plotters, facsimile machines, and multifunction devices having two or more of printing, copying, plotting, and facsimile functions, recording media are generally supplied from a sheet feed cassette attached to the image forming apparatus.

In order to achieve user-friendliness, it is desirable that the image forming apparatus have a front-access configuration in which both supply of the recording media and retrieval of recording media having images thereon are performed by a user from the front side of the apparatus. Therefore, regardless of the type of system employed in the image forming apparatus, whether an electrophotographic system or an inkjet recording system, the sheet feed cassette that holds a stack of recording media is generally disposed to a lower portion of the image forming apparatus so that the recording media can be supplied from the front side of the apparatus. During image formation, a recording medium fed from the sheet feed cassette is conveyed to an image forming part to form an image on the recording medium. The recording medium having the image thereon is then discharged to an internal discharge tray or a discharge tray provided to an upper front portion of the apparatus and is retrieved by the user from the front side of the apparatus.

In an inkjet-type image forming apparatus, recording media fed from the sheet feed cassette often make a U-turn during image formation and are discharged from the image forming apparatus with a side having an image thereon facing up. Such a configuration makes the image forming apparatus more compact, and secures time to dry out ink on the recording media after image formation, thereby preventing adherence of ink to the discharge tray. Although the recording media discharged from the image forming apparatus are stacked on the discharge tray in reverse order when images are formed on multiple recording media consecutively, such a problem can be often solved using software now. The multiple recording media consecutively discharged from the image forming apparatus may be more easily stacked on the discharge tray in the proper order by making a U-turn twice during image formation so as to be discharged with the side having the image thereon facing down. However, such a configuration increases the height of the image forming apparatus. In particular, the less-frequent use of image forming apparatuses in small offices or by consumers prioritizes reduction of installation space of the apparatuses. Thus, compactness and inexpensiveness of the image forming apparatuses are in greater demand.

In order to handle recording media in a variety of sizes, the sheet feed cassette of a compact image forming apparatus is configured to be extendable so that even large-sized recording media can be accommodated in the sheet feed cassette. As a result, the sheet feed cassette is sometimes protruding from the image forming apparatus when being extended. Meanwhile, when not in use or holding small-sized recording media, the sheet feed cassette is contracted to be flush with the side of the image forming apparatus. The extendable sheet feed cassette is well known and often employed in the image forming apparatuses.

In some related-art extendable sheet feed cassettes, an opening of the sheet feed cassette from which the recording media are supplied is exposed to the outside of the image forming apparatus, allowing entrance of dust within the image forming apparatus and dampness on the recording media placed within the sheet feed cassette. Dust often causes various problems in the image forming apparatuses and the damp recording media may cause irregular image formation. In order to prevent these, it is conceivable that the sheet feed cassette is accommodated within the image forming apparatus. However, the compactness of contemporary image forming apparatuses sometimes prevents accommodation of the sheet feed cassette that can handle large-sized recording media within the image forming apparatus.

For the above reason, the opening of the sheet feed cassette is often covered with a cassette cover attached to the sheet feed cassette. However, attachment of the cassette cover only when the sheet feed cassette is extended burdens the user. In the worst case, the cassette cover may be lost and the opening of the sheet feed cassette may be uncovered, resulting in irregular images caused by dust entering the image forming apparatus and the damp recording media.

In the previously-described image forming apparatus in which the recording medium fed from the sheet feed cassette makes a U-turn during image formation so as to be discharged with the side having the image thereon facing up, the sheet feed cassette and the discharge tray are often disposed close to each other due to the compact structure of the image forming apparatus. Taking advantage of the close proximity of the sheet feed cassette to the discharge tray, an extendable cassette cover is accommodated within the discharge tray so that the cassette cover is withdrawn from the discharge tray to cover the opening of the sheet feed cassette when the sheet feed cassette is extended. However, the cassette cover withdrawn from the discharge tray fixed to the image forming apparatus hinders removal of a jammed recording medium from a portion of the sheet feed cassette in which the recording medium is picked up. In addition, the discharge tray also often needs to be extended to handle recording media in a variety of sizes due to compactness of the image forming apparatus. Improper operation of the extendable discharge tray may cause irregular stacking of the recording media on the discharge tray. Consequently, the recording media discharged from the image forming apparatus may drop off from the discharge tray or may not be sequentially stacked on the discharge tray in the proper order.

Thus, upon change of the size of the recording media held by the sheet feed cassette, not only the sheet feed cassette but sometimes also the cassette cover need to be detached from and reattached to the image forming apparatus when the sheet feed cassette is extended or contracted to accommodate the recording media. Further, the discharge tray also needs to be extended or contracted, thereby inconveniencing the user and possibly causing improper setting of the sheet feed cassette, the cassette cover, or the discharge tray.

In order to prevent deformation, damage, or jam of recording media caused by improper operation of the extendable sheet feed cassette, JP-2010-006592-A proposes a configuration in which a sheet feed cassette and a discharge tray are integrally extendable and a member that restricts contraction of the sheet feed cassette while the sheet feed cassette is attached to the image forming apparatus is provided. However, provision of such a member increases production costs.

In another approach (JP-H07-133050-A), a state of the discharge tray is changeable in conjunction with extension and contraction of the sheet feed cassette, such that an auxiliary discharge tray can be used depending on the size of recording media in a compact image forming apparatus. However, this approach complicates the configuration of the image forming apparatus and also increases production costs.

BRIEF SUMMARY OF THE INVENTION

In view of the foregoing, illustrative embodiments of the present invention provide a novel image forming apparatus in which both supply of recording media to a sheet feed cassette and retrieval of recording media discharged from the image forming apparatus can be performed by a user from the front side of the image forming apparatus. Upon change of the size of the recording media held by the sheet feed cassette, the sheet feed cassette, a cassette cover, and a discharge tray can be easily set to their proper positions corresponding to the size of the recording media.

In one illustrative embodiment, an image forming apparatus includes a sheet feed cassette to hold a stack of recording media, a cover detachably attachable to the sheet feed cassette to cover an opening of the sheet feed cassette through which the recording media are supplied, an image forming part to form images on the recording media, and a discharge tray having a top surface on which the recording media discharged from the image forming apparatus after image formation are stacked. The cover is detached from and reattached to the sheet feed cassette upon supply of the recording media to the sheet feed cassette. The sheet feed cassette is disposed below the discharge tray and is contractibly extendable, protruding outwardly from the image forming apparatus to accommodate large-sized recording media in its extended state. The cover includes a displaceable discharge auxiliary member slidable against the cover so as to be flush with the top surface of the discharge tray and detachably attachable to the sheet feed cassette together with the cover.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
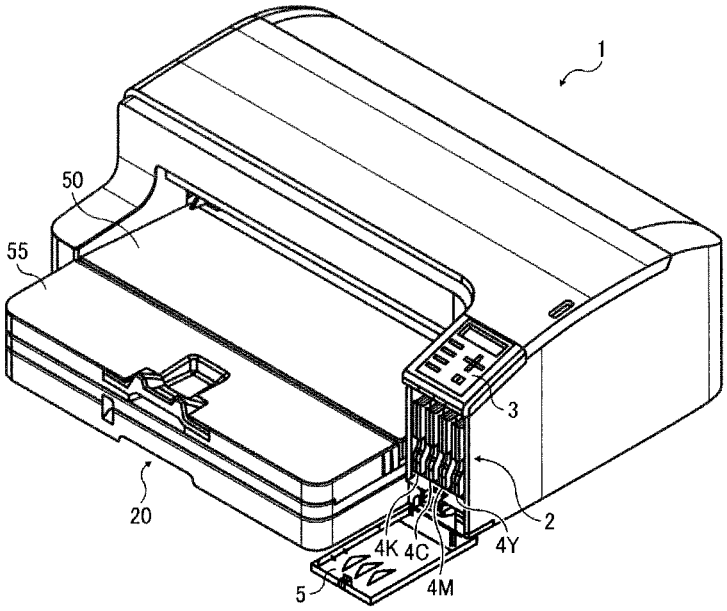
FIG. 1 is a perspective view illustrating an external appearance of an example of an image forming apparatus according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Figure 2:
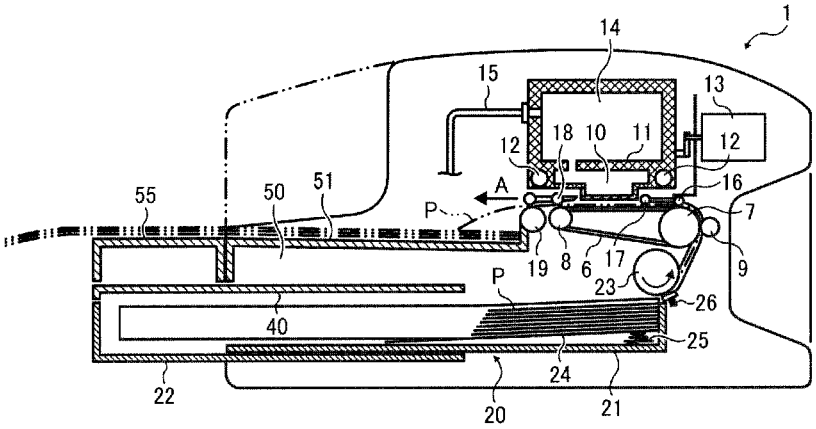
FIG. 2 is a vertical cross-sectional view illustrating an example of an internal configuration of the image forming apparatus.

A description is now given of a configuration and operation of an image forming apparatus 1 according to a first illustrative embodiment, with reference to FIGS. 1 and 2.

FIG. 1 is a perspective view illustrating an external appearance of an example of the image forming apparatus 1 viewed from the front. FIG. 2 is a vertical cross-sectional view illustrating an example of an internal configuration of the image forming apparatus 1. The image forming apparatus 1 includes a sheet feed cassette 20 and a discharge tray 50, both provided to a front part of the image forming apparatus 1. The sheet feed cassette 20 holds a stack of multiple recording media P to be supplied to the image forming apparatus 1. Recording media on which images are formed are discharged from the image forming apparatus 1 and are stacked on the discharge tray 50. The image forming apparatus 1 further includes a cartridge loading part 2 provided to one end of the front part of the image forming apparatus 1 to load ink cartridges. An operating/display unit 3 having operating buttons and a display thereon is provided on an upper surface of the cartridge loading part 2.

Multiple liquid cartridges 4K, 4C, 4M, and 4Y (hereinafter collectively referred to as liquid cartridges 4) each storing ink of a specific color, that is, black (K), cyan (C), magenta (M), or yellow (Y), are inserted into the cartridge loading part 2 from the front to the rear of the image forming apparatus 1 so as to be loaded into the cartridge loading part 2. A hinged front cover 5 closably openable relative to the cartridge loading part 2 is provided to a front portion of the cartridge loading part 2. The front cover 5 is opened upon attachment and detachment of the liquid cartridges 4 to and from the cartridge loading part 2.

The sheet feed cassette 20 is detachably attachable to a lower part of the image forming apparatus 1 and is constructed of a main part 21 and a sub-part 22, each slidably articulated with the other as described in detail later and each holding the stack of multiple recording media P. The main part 21 is provided downstream from the sub-part 22 in a direction of attachment of the sheet feed cassette 20 to the image forming apparatus 1. The sub-part 22 of the sheet feed cassette 20 is exposed outside the image forming apparatus 1. Upon supply of the recording media P to the sheet feed cassette 20, a user holds the sub-part 22 to detach the sheet feed cassette 20 from the image forming apparatus 1. A sheet feed roller 23 is provided at a leading edge of the sheet feed cassette 20 in a direction of conveyance of the recording media P to contact a leading edge on an upper surface of a recording medium P placed on the top of the stack of multiple recording media P (hereinafter referred to as the top recording medium P). A movable bottom plate 24 on which the stack of multiple recording media P is placed is provided in a lower portion of the sheet feed cassette 20, and is supplied with a pressing force by a pressing unit 25 such that the stack of recording media P is pressed against the sheet feed roller 23. A separation member 26 that prevents multiple feeding of the recording media P is provided below the sheet feed roller 23.

When the sheet feed roller 23 is rotated in a counterclockwise direction in FIG. 2, the top recording medium P is separated from the stack of multiple recording media P stored in the sheet feed cassette 20 by the separation member 26 to be fed to an image forming part of the image forming apparatus 1. The recording medium P thus fed is pressed by a first conveyance roller 9 while passing through a U-turn conveyance path to be attracted to an electrostatic belt 6. The electrostatic belt 6 is wound around a drive roller 7 and a driven roller 8 and conveys the recording medium P to the image forming part in a direction indicated by arrow A in FIG. 2 using a drive unit and a charger, both not shown, while attracting the recording medium P thereon.

In the present illustrative embodiment, the image forming part is a carriage 11 mounting an inkjet recording head 10. The carriage 11 is guided by guide rods 12 to be moved reciprocally back and forth in a main scanning direction perpendicular to the plane of FIG. 2 by a drive source, that is, a main scanning motor 13.

Ink is conveyed from the liquid cartridges 4 to a sub-tank 14 via an ink tube 15 so that the inkjet recording head 10 is supplied with the ink. The inkjet recording head 10 ejects minute ink droplets while the carriage 11 is moving reciprocally back and forth so that the ink droplets are landed on the recording medium P conveyed by the electrostatic belt 6 to form an image on the recording medium P.

A pressing roller 16 and a front pressing roller 17 are provided upstream from the inkjet recording head 10, and a spur 18 is provided downstream from the inkjet recording head 10, respectively, in the direction of conveyance of the recording medium P. The electrostatic belt 6, the pressing roller 16, the front pressing roller 17, and the spur 18 together flatten the recording medium P during image formation. At that time, a distance between the inkjet recording head 10 and the recording medium P is kept constant to form high-quality images without offset of landing positions of the ink droplets on the recording medium P. The recording medium P having the image thereon is then conveyed by a pair of discharge rollers 19 to be discharged to the discharge tray 50.

Figure 3:
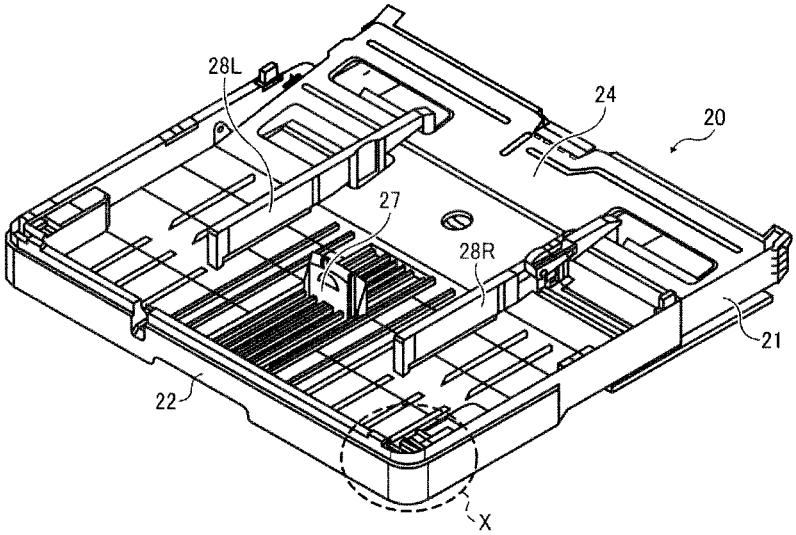
FIG. 3 is a perspective view illustrating an example of a configuration of a sheet feed cassette in a normal state.
Figure 4:
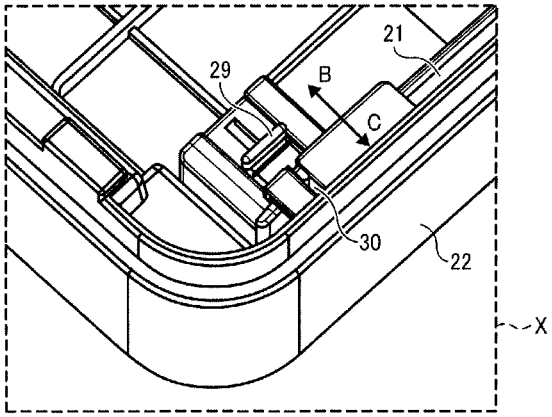
FIG. 4 is an enlarged perspective view illustrating a corner X of the sheet feed cassette illustrated in FIG. 3.

A description is now given of a detailed configuration of the sheet feed cassette 20 with reference to FIGS. 3 and 4. FIG. 3 is a perspective view illustrating an example of a configuration of the sheet feed cassette 20 in a normal state. FIG. 4 is an enlarged perspective view illustrating a corner X of the sheet feed cassette 20 illustrated in FIG. 3.

As described previously, the sheet feed cassette 20 is constructed of the main part 21 and the sub-part 22. The movable bottom plate 24 and right and left side fences 28R and 28L (hereinafter collectively referred to as side fences 28), each restricting both right and left edges of the stack of recording media P, are provided inside the main part 21 of the sheet feed cassette 20. The sub-part 22 is provided with an end fence 27 that restricts a trailing edge of the stack of recording media P accommodated in the sheet feed cassette 20. Each of the side fences 28 and the end fence 27 is movable relative to the main part 21 and the sub-part 22, respectively, depending on the size of the stack of recording media P accommodated in the sheet feed cassette 20. FIG. 3 illustrates the normal state of the sheet feed cassette 20 in which the sheet feed cassette 20 is contracted, and each of the end fence 27 and the side fences 28 is positioned to accommodate a stack of recording media P of A4 size. In the normal state, the sheet feed cassette 20 can accommodate a stack of recording media P of A3 size at a maximum by moving the end fence 27 and the side fences 28 to the appropriate positions.

Figure 5:
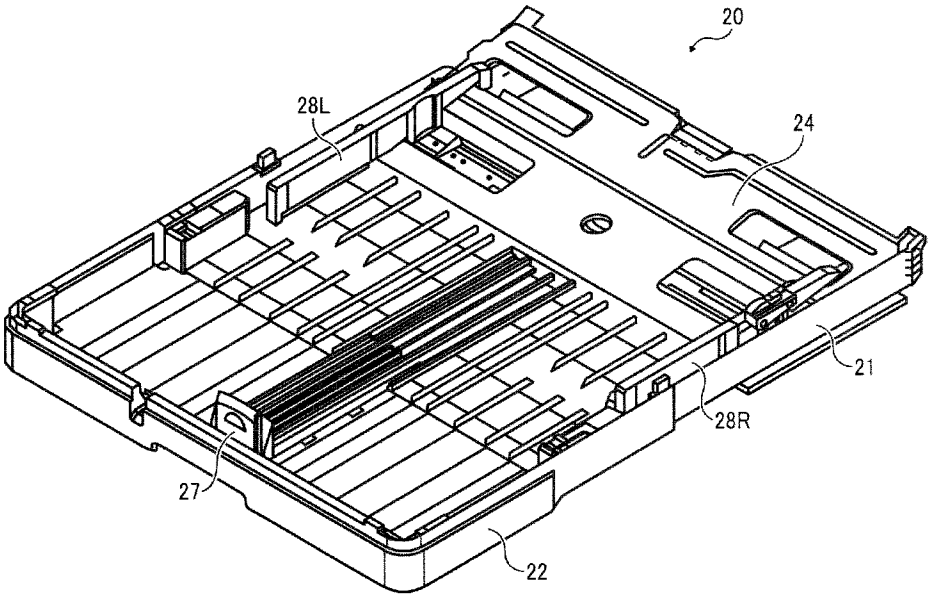
FIG. 5 is a perspective view illustrating an example of a configuration of the sheet feed cassette in an extended state.

FIG. 5 is a perspective view illustrating an example of a configuration of the sheet feed cassette 20 in an extended state. In order to extend the sheet feed cassette 20, first, cassette lock members 29 provided to both right and left front corners of the sheet feed cassette 20, respectively, are disengaged from lock notches 30 in a direction B of double-headed arrow in FIG. 4. It is to be noted that, only the right corner X of the sheet feed cassette 20 is shown in FIG. 4. Then, the main part 21 and the sub-part 22 slide against each other to extend the sheet feed cassette 20. Thereafter, the lock members 29 engage the lock notches 30 in a direction C of the double-headed arrow in FIG. 4, and that transforms the sheet feed cassette 20 into the extended state illustrated in FIG. 5. In illustrative embodiments, the sheet feed cassette 20 can be extended to accommodate a stack of recording media P of A2 size at a maximum.

Thus, the single sheet feed cassette 20 can handle the recording media P of a variety of sizes, thereby providing a user-friendly configuration at a reduced cost.

Figure 6:
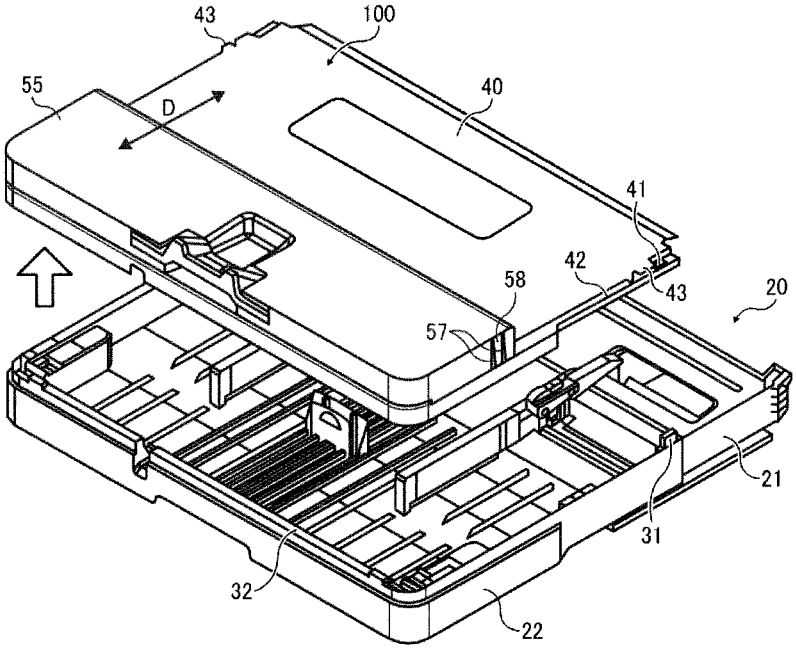
FIG. 6 is a perspective view illustrating a cassette cover and the sheet feed cassette in the normal state.

A cassette cover 40 that protects the recording media P held by the sheet feed cassette 20 from dust and mist within the image forming apparatus 1 is provided to the sub-part 22 of the sheet feed cassette 20. FIG. 6 is a perspective view illustrating the cassette cover 40 and the sheet feed cassette 20 in the normal state. The cassette cover 40 prevents supply of recording media P to the sheet feed cassette 20 during image formation. Positioning protrusions 31 are provided to upper rear right and left corners of the sub-part 22 closer to the main part 21, and fit into holes 41, respectively, formed in the cassette cover 40. An outer periphery of the cassette cover 40 is placed on a step 32 formed along an outer periphery of the sub-part 22 so that an opening of the sheet feed cassette 20 from which the recording media P are supplied is covered with the cassette cover 40. The cassette cover 40 is designed to cover throughout a portion of the sheet feed cassette 20 protruding from the image forming apparatus 1 even when the sheet feed cassette 20 is extended. Accordingly, the recording media P held by the sheet feed cassette 20 are protected from dust and mist when the sheet feed cassette 20 is extended as well as when it is in the normal state.

A discharge auxiliary member 55, which forms a part of a top surface 51 of the discharge tray 50, is provided on the cassette cover 40. The discharge auxiliary member 55 has an inverted box-shape, and a top surface of the discharge auxiliary member 55 is continuous with the top surface 51 of the discharge tray 50 as illustrated in FIG. 2.

Accordingly, the recording media P of any size accommodated in the sheet feed cassette 20 can be stacked on the top surface 51 of the discharge tray 50 and the discharge auxiliary member 55.

The discharge auxiliary member 55 is supported by the cassette cover 40 and is moved together with the cassette cover 40 in a direction of extension of the sheet feed cassette 20 when the sheet feed cassette 20 is extended. As a result, a recessed portion 100 is formed in the top surface 51 of the discharge tray 50 as illustrated in FIG. 6. Consequently, a leading edge of the recording medium P discharged from the image forming apparatus 1 hits the recessed portion 100, thereby preventing appropriate stacking of the recording medium P on the discharge tray 50.

Figure 7:
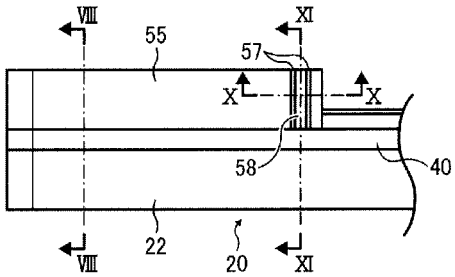
FIG. 7 is a partial side view illustrating the sheet feed cassette.
Figure 8:
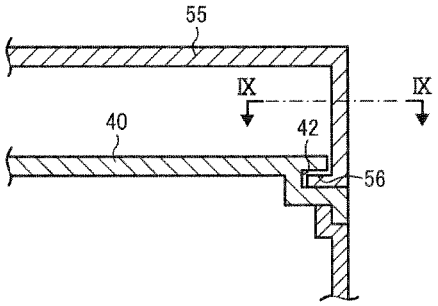
FIG. 8 is a cross-sectional view taken along a line VIII-VIII in FIG. 7.
Figure 9:
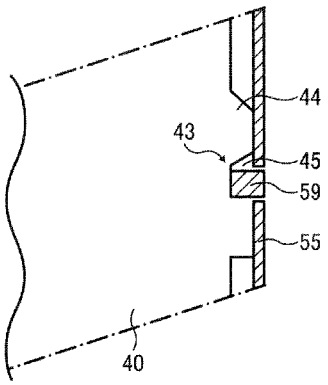
FIG. 9 is a plan view taken along a line IX-IX in FIG. 8.
Figure 10:
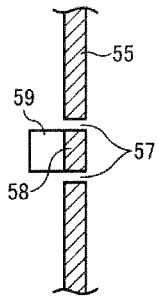
FIG. 10 is a cross-sectional view taken along a line X-X in FIG. 7.
Figure 11:
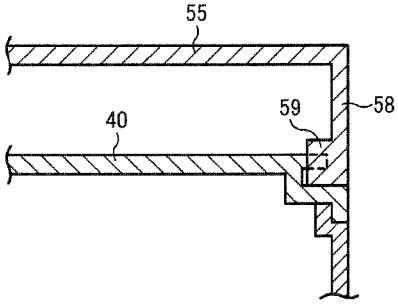
FIG. 11 is a cross-sectional view taken along a line XI-XI in FIG. 7.

The actions taken in illustrative embodiments to prevent the above-described problem are described below with reference to FIGS. 7 to 11. FIG. 7 is a partial side view illustrating the sheet feed cassette 20. FIG. 8 is a cross-sectional view taken along a line VIII-VIII in FIG. 7. FIG. 9 is a plan view taken along a line IX-IX in FIG. 8. FIG. 10 is a cross-sectional view taken along a line X-X in FIG. 7. FIG. 11 is a cross-sectional view taken along a line XI-XI in FIG. 7.

A recessed rail portion 42 is formed in both lateral side surfaces of the cassette cover 40 extending substantially the entire length thereof. A protruding rail portion 56 formed in a folded leading edge of both lateral surfaces of the discharge auxiliary member 55 engages the recessed rail portion 42 with a slight looseness therebetween as illustrated in FIG. 8, to allow the discharge auxiliary member 55 to slide in directions indicated by double-headed arrow D in FIG. 6. Thus, the discharge auxiliary member is slidably attached to the cassette cover 40. A positioning portion 43 that stops movement of the discharge auxiliary member 55 is formed in each of the recessed rail portions 42. As illustrated in FIG. 9, the positioning portion 43 is constructed of a gently protruding engagement portion 44 and a substantially right-angled recessed engagement portion 45.

Two slits 57 are formed in each of the lateral surfaces of the discharge auxiliary member 55, and an engagement portion 58 is formed between the two slits 57. An engagement block 59 is provided to a leading edge of the engagement portion 58 at a portion stepping over the protruding rail portion 56 between the two slits 57. It is to be noted that, although only the single lateral surface of each of the cassette cover 40 and the discharge auxiliary member 55 is shown in FIGS. 8 and 9, the components to position the discharge auxiliary member 55 are provided on both lateral surfaces of each of the cassette cover 40 and the discharge auxiliary member 55, respectively.

The positioning portion 43 is provided to each of front and rear parts of the recessed rail portion 42 in a longitudinal direction. The positioning portion 43 provided to the front part of the recessed rail portion 42 positions the discharge auxiliary member 55 to the normal position, and the front outer periphery of the discharge auxiliary member 55 substantially engages the outer periphery of the sub-part 22 at that position. The positioning portion 43 provided to the rear part of the recessed rail portion 42 positions the discharge auxiliary member 55 to the extended position described in detail later.

A description is now given of steps of extending the sheet feed cassette 20 from the normal state such that a stack of large-sized recording media P can be accommodated in the sheet feed cassette 20.

Figure 12:
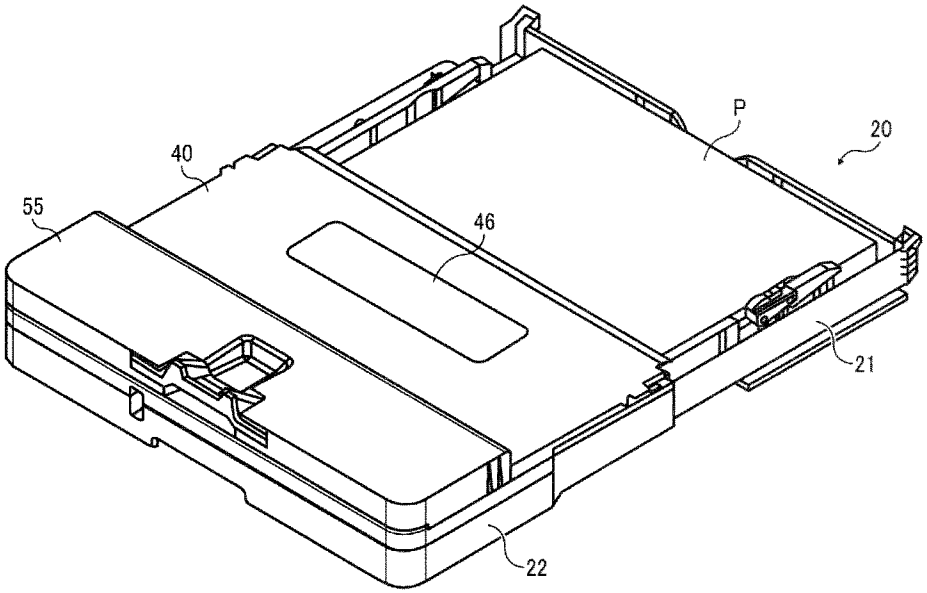
FIG. 12 is a perspective view illustrating the sheet feed cassette in the extended state.

After the sheet feed cassette 20 is extended in accordance with the steps described previously with reference to FIGS. 3 to 5, the side fences 28 and the end fence 27 are moved corresponding to the size of the stack of recording media P so that the sheet feed cassette 20 accommodates the stack of large-sized recording media P. Thereafter, the sheet feed cassette 20 is covered with the cassette cover 40 by fitting the positioning protrusions 31 of the sheet feed cassette 20 into the holes 41 formed in the cassette cover 40, respectively. FIG. 12 is a perspective view illustrating the sheet feed cassette 20 in the extended state to which the cassette cover 40 is attached.

Figure 13:
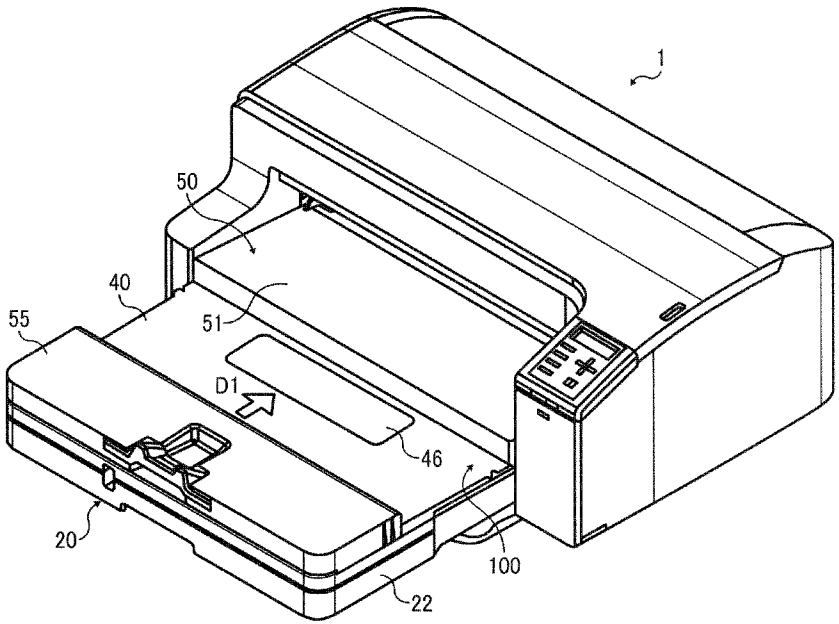
FIG. 13 is a perspective view illustrating the image forming apparatus immediately after attachment of the extended sheet feed cassette.

FIG. 13 is a perspective view illustrating the image forming apparatus 1 to which the sheet feed cassette 20 extended as illustrated in FIG. 12 is attached.

In FIG. 13, the sheet feed cassette 20 immediately after being extended is attached to the image forming apparatus 1. Therefore, the front outer periphery of the discharge auxiliary member 55 corresponds to the outer periphery of the sub-part 22. Because the discharge auxiliary member 55 is placed at the normal position in FIG. 13, the discharge auxiliary member 55 is separated from the top surface 51 of the discharge tray 50, thereby forming a step therebetween, that is, the recessed portion 100 in the cassette cover 40. Consequently, in this state the leading edge of the recording medium P discharged form the image forming apparatus 1 hits the wall formed by the discharge auxiliary member 55, preventing appropriate stacking of the recording medium P on the discharge tray 50.

Figure 14:
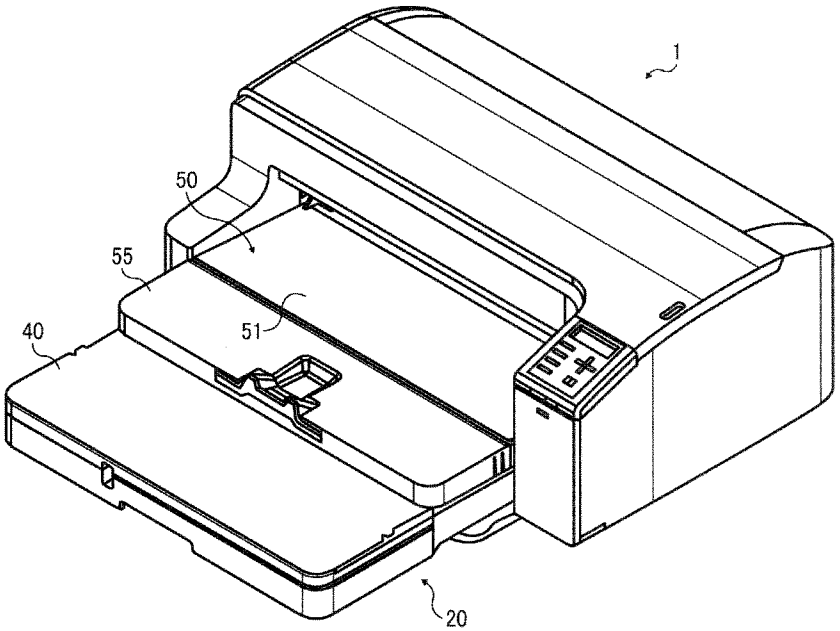
FIG. 14 is a perspective view illustrating the image forming apparatus after the extended sheet feed cassette is attached thereto and a discharge auxiliary member is moved at its proper position.

To prevent the above-described problem, the recessed portion 100 formed in the cassette cover 40 is configured to visually prompt the user to move the discharge auxiliary member 55 to an extended position in a direction indicated by arrow D1 in FIG. 13. As a result, the discharge auxiliary member 55 is placed at the extended position as illustrated in FIG. 14 so that the discharge auxiliary member 55 is continuous with the top surface 51 of the discharge tray 50, thereby achieving proper stacking of the recording medium P discharged from the image forming apparatus 1. It is to be noted that, in order to more clearly show the recessed portion 100 to the user, it is preferable that both the discharge tray 50 and the discharge auxiliary member 55 have the same color whereas the cassette cover 40 has a clearly different. In addition, it is preferable that the cassette cover 40 be formed of a transparent resin material so that the user can easily confirm the number of recording media P held in the sheet feed cassette 20.

If it is advantageous to always make the discharge auxiliary member 55 continuous with the discharge tray 50, it is conceivable that the discharge auxiliary member 55 may be supported by the discharge tray 50 in place of the cassette cover 40. However, if the discharge auxiliary member 55 is supported by the discharge tray 50, an attachment opening of the image forming apparatus 1 to which the sheet feed cassette 20 is attached is hidden under the discharge auxiliary member 55, thereby hindering easy attachment and detachment of the sheet feed cassette 20 to and from the image forming apparatus 1.

In the image forming apparatus 1 according to the present illustrative embodiment, the recessed portion 100 is visible to the user to prompt the user to move the discharge auxiliary member 55 to the proper position as described above. Alternatively, a warning label 46 that prompts the user to move the discharge auxiliary member 55 to the proper position may be bonded to the cassette cover 40 as illustrated in FIGS. 12 and 13. The warning label 46 is bonded at any position visible to the user when the discharge auxiliary member 55 needs to be moved to the proper position, and that does not degrade the integrity of the external design or appearance of the image forming apparatus 1.

During movement of the discharge auxiliary member 55 between the normal position and the extended position, the discharge auxiliary member 55 slides against the recessed rail portion 42 of the cassette cover 40, and the engagement block 59 provided to the leading edge of the engagement portion 58 of the discharge auxiliary member 55 engages the positioning portion 43 provided to the recessed rail portion 42 at the normal or extended position. Accordingly, the discharge auxiliary member 55 can be appropriately moved to the normal position or the extended position. Even when the discharge auxiliary member 55 is moved strongly, the protruding engagement portion 44 prevents displacement of the discharge auxiliary member 55.

Figure 15:
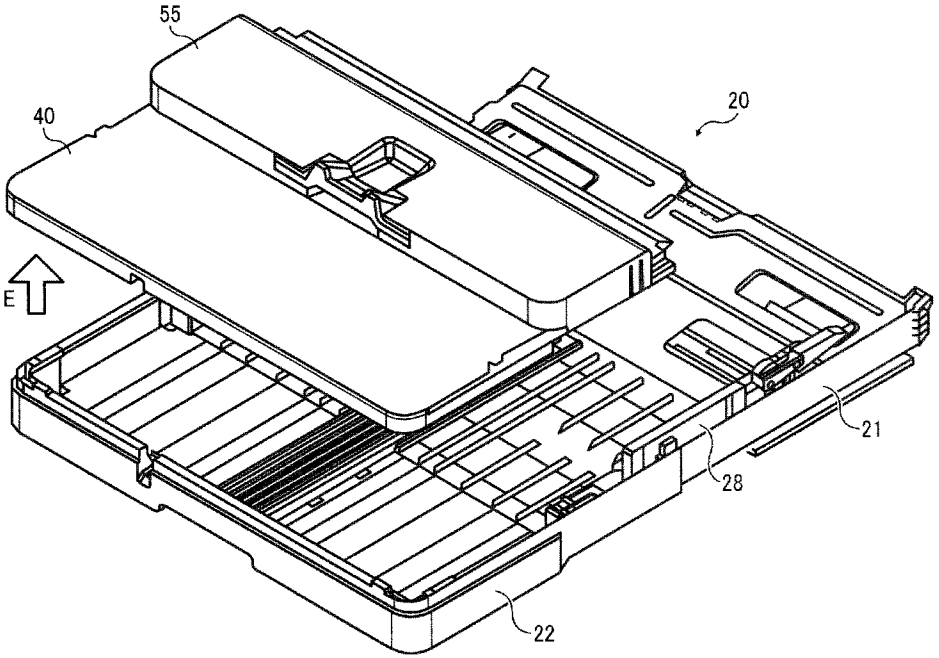
FIG. 15 is a perspective view illustrating the cassette cover and the sheet feed cassette in the extended state.
Figure 16:
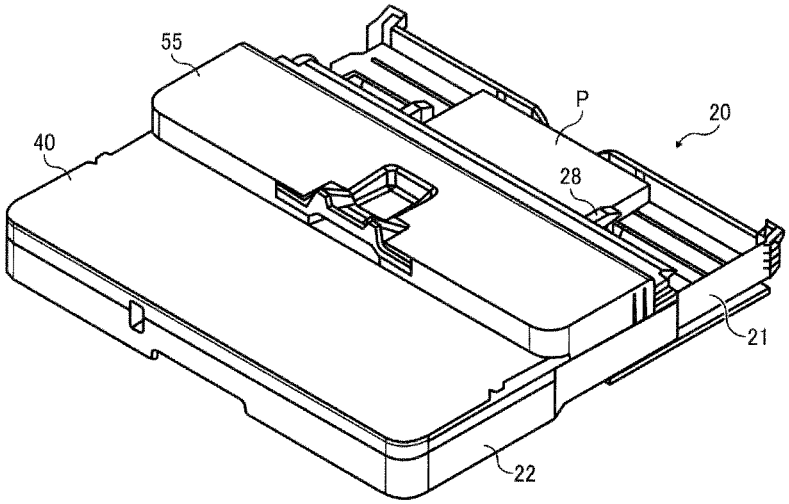
FIG. 16 is a perspective view illustrating the sheet feed cassette after being contracted.

A description is now given of steps of contracting the sheet feed cassette 20 from the extended state such that small-sized recording media P can be accommodated in the sheet feed cassette 20. The steps of contraction of the sheet feed cassette 20 are the reverse of the steps of extension of the sheet feed cassette 20 described above. FIG. 15 is a perspective view illustrating the sheet feed cassette 20 in the extended state detached from the image forming apparatus 1 illustrated in FIG. 14. After detachment of the sheet feed cassette 20 from the image forming apparatus 1, the cassette cover 40 is removed from the sheet feed cassette 20 to a direction indicated by arrow E in FIG. 15. Then, the sub-part 22 is contracted so that the sheet feed cassette 20 is returned to its normal size. Next, the side fences 28 and the end fence 27 are moved corresponding to the size of the stack of recording media P accommodated in the sheet feed cassette 20. Thereafter, the sheet feed cassette 20 is covered with the cassette cover 40 by fitting the positioning protrusions 31 of the sheet feed cassette 20 into the holes 41 formed in the cassette cover 40. FIG. 16 is a perspective view illustrating the sheet feed cassette 20 after being contracted as described above.

Figure 17:
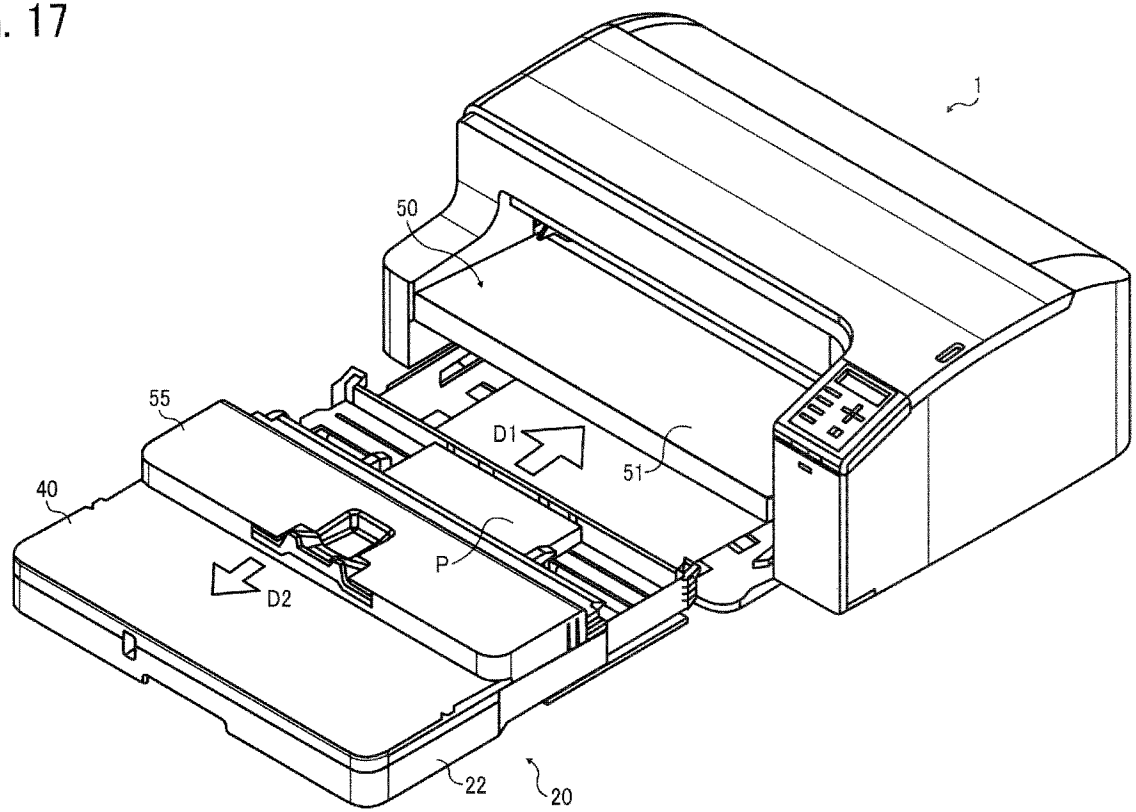
FIG. 17 is a perspective view illustrating a state in which the sheet feed cassette in the extended state is to be attached to the image forming apparatus.
Figure 18:
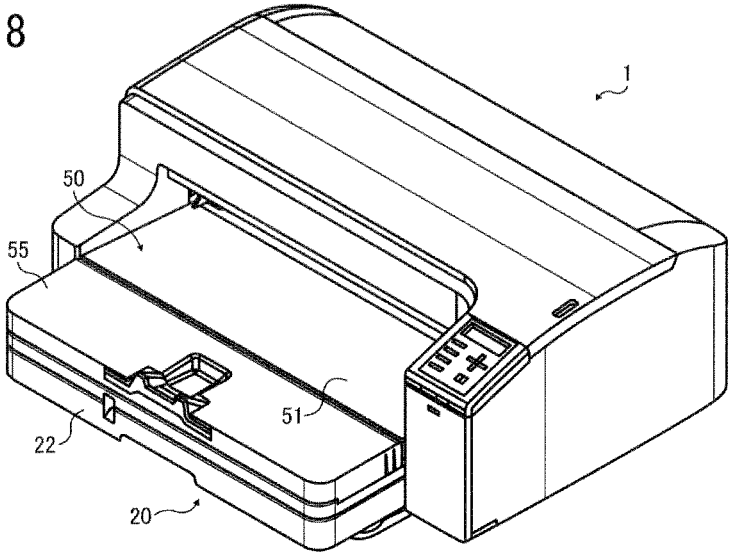
FIG. 18 is a perspective view illustrating the image forming apparatus to which the sheet feed cassette in the normal state is attached.

FIG. 17 is a perspective view illustrating a state in which the sheet feed cassette 20 illustrated in FIG. 16 is to be attached to the image forming apparatus 1. When the sheet feed cassette 20 is inserted into the image forming apparatus 1 in the direction of the arrow D1, the discharge auxiliary member 55 contacts the discharge tray 50 and slides against the cassette cover 40 in the direction of arrow D2. Accordingly, the discharge auxiliary member 55 is automatically moved forward as illustrated in FIG. 18 upon attachment of the sheet feed cassette 20 to the image forming apparatus 1. Thus, insertion of the sheet feed cassette 20 into the image forming apparatus 1 automatically moves the discharge auxiliary member 55 to the position corresponding to the small-sized recording media P, thereby facilitating operation.

In addition, the sheet feed cassette 20 is detachably attachable to the image forming apparatus 1 together with the cassette cover 40 and the discharge auxiliary member 55. Accordingly, paper jam at the sheet feed roller 23 can be easily fixed compared to the related-art image forming apparatus in which the discharge auxiliary member is fixed to the discharge tray.

Alternatively, the sheet feed cassette 20 may be withdrawably attachable to the image forming apparatus 1 together with the cassette cover 40 and the discharge auxiliary member 55 using rails or the like.

Thus, in the image forming apparatus 1 according to the present illustrative embodiment, both supply of the recording media P to the sheet feed cassette 20 and retrieval of the recording media P discharged from the image forming apparatus 1 can be performed from the front side of the image forming apparatus 1. The sheet feed cassette 20 is covered with the cassette cover 40 to protect the recording media P held by the sheet feed cassette 20 from dust and mist, thereby providing higher-quality images. In addition, the sheet feed cassette 20 is extendable to handle the recording media P of a variety of sizes so that even large-sized recording media P can be used in the compact image forming apparatus 1. The sheet feed cassette 20, the cassette cover 40, and the discharge tray 50 can be easily moved to their proper positions corresponding to the size of the recording media P, thereby providing user-friendly configuration at reduced cost.

Figure 19:
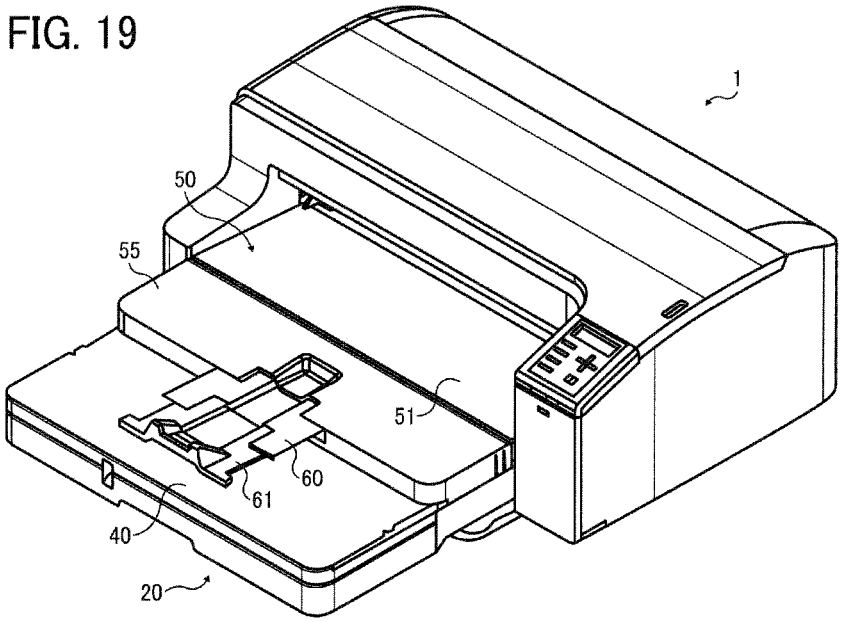
FIG. 19 is a perspective view illustrating an example of a configuration of an image forming apparatus according to a second illustrative embodiment.

FIG. 19 is a perspective view illustrating the image forming apparatus 1 according to a second illustrative embodiment. In the second illustrative embodiment, extensions 60 and 61 are extendably accommodated within the discharge auxiliary member 55. In the state illustrated in FIG. 19, both the extensions 60 and 61 are extended from the discharge auxiliary member 55. Given normal stiffness, the recording medium P discharged from the image forming apparatus 1 is properly stacked on the discharge tray 50 and the discharge auxiliary member 55 without the extensions 60 and 61. However, when the recording medium P is thin, has less stiffness, or tends to be bent, use of the extensions 60 and 61 provides better stacking of the recording medium P on the discharge tray 50 and the discharge auxiliary member 55.

If the discharge auxiliary member 55 is inadvertently moved while the extensions 60 and 61 are being extended, the discharge auxiliary member 55 needs to be returned to its original position after extension of the extensions 60 and 61, inconveniencing the user. Therefore, a force necessary for moving the engagement block 59 of the discharge auxiliary member 55 beyond the protruding engagement portion 44 of the cassette cover 40 is set larger than a force necessary for extending the extensions 60 and 61. As a result, inadvertent movement of the discharge auxiliary member 55 is prevented during extension of the extensions 60 and 61, thereby facilitating operation.

Figure 20:
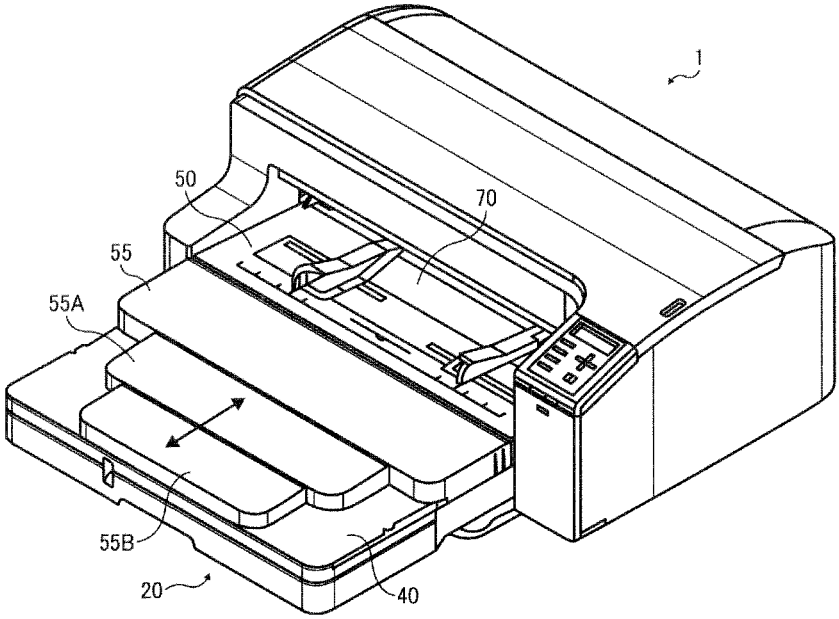
FIG. 20 is a perspective view illustrating an example of a configuration of an image forming apparatus according to a third illustrative embodiment.

FIG. 20 is a perspective view illustrating the image forming apparatus 1 according to a third illustrative embodiment. The discharge auxiliary member 55 according to the third illustrative embodiment has a nested configuration such that auxiliary child members 55A and 55B are accommodated within the discharge auxiliary member 55. It is to be noted that reference numeral 70 in FIG. 20 denotes a well-known manual sheet feed cassette. The auxiliary child member 55B is fixed to the front edge of the cassette cover 40. Top surfaces of the auxiliary child members 55B and 55A sequentially appear, in that order, by moving the discharge auxiliary member 55 backward. Each of the discharge auxiliary member 55 and the auxiliary child members 55A and 55B is box-shaped and is not deformed by the large number of recording media P discharged thereonto from the image forming apparatus 1, thereby providing better stacking of the recording media P. In addition, the discharge auxiliary member 55 and the auxiliary child members 55A and 55B are not deformed by a force supplied from above by the user who is supplying the recording media P to the manual sheet feed cassette 70.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein.

For example, elements and/or features of different illustrative embodiments may be combined with each other and/or substituted for each other within the scope of this disclosure and appended claims.

Figure 21:
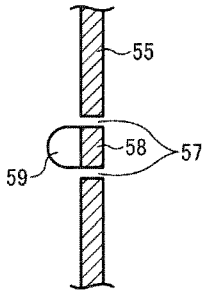
FIG. 21 is a cross-sectional view illustrating an engagement block according to a first variation.
Figure 22:
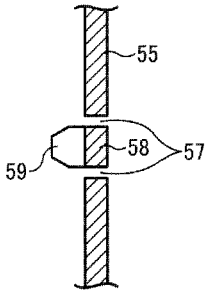
FIG. 22 is a cross-sectional view illustrating an engagement block according to a second variation.

A shape of the engagement block 59 provided to the leading edge of the engagement portion 58 is not limited to a rectangle as illustrated in FIG. 10. Alternatively, it may have rounded corners as illustrated in FIG. 21 or chamfered corners as illustrated in FIG. 22.

In the light of compactness and secure drying of an image formed on the recording medium, the foregoing illustrative embodiments are considerably advantageous for inkjet-type image forming apparatuses such as the image forming apparatus 1 in which the recording medium makes a U-turn during image formation to be discharged with a side having the image thereon facing up. The foregoing illustrative embodiments are also applicable to image forming apparatuses without employing the inkjet recording system as long as both supply of the recording media to the sheet feed cassette and retrieval of the recording media discharged from the apparatus are performed from the front side of the apparatus and the discharge tray is provided above the sheet feed cassette.

What is claimed is:

1. An image forming apparatus, comprising:

an image forming apparatus body;

a sheet feed cassette to hold a stack of recording media;

a cover detachably attachable to the sheet feed cassette to cover an opening of the sheet feed cassette through which the recording media are supplied, the cover being detached from and reattached to the sheet feed cassette upon supply of the recording media to the sheet feed cassette;

an image forming part to form images on the recording media; and a discharge tray attached to a front portion of the image forming apparatus body, wherein a top surface of the discharge tray receives and stacks the recording media discharged from the image forming apparatus body after image formation, wherein the sheet feed cassette is disposed below the discharge tray to protrude outwardly from the image forming apparatus body, and wherein a front end of the sheet feed cassette extends in a frontward direction beyond a front end of the discharge tray and is configured to be extendable, in the frontward direction that is opposite to a backward direction from the front portion of the image forming apparatus body towards a back portion of the image forming apparatus body, from a contracted state to an extended state to accommodate, in the extended state of the sheet feed cassette, large-sized recording media, and in the extended state of the sheet feed cassette, an extent from a front end of the sheet feed cassette to a back end of the sheet feed cassette is greater than an extent from the front end of the sheet feed cassette to the back end of the sheet feed cassette in the contracted state, and wherein the cover comprises a displaceable discharge auxiliary member disposed on the cover and slidable against the cover to position the discharge auxiliary member to be flush with the top surface of the discharge tray and detachably attachable to the sheet feed cassette together with the cover.

2. The image forming apparatus according to claim 1, wherein:

the discharge tray and the discharge auxiliary member have the same color; and the cover has a color different from the color of the discharge tray and the discharge auxiliary member.

3. The image forming apparatus according to claim 2, wherein the cover is formed of a transparent resin material.

4. The image forming apparatus according to claim 1, wherein the discharge auxiliary member is substantially box-shaped with a top surface flush with the top surface of the discharge tray.

5. The image forming apparatus according to claim 1, wherein:

each of the discharge auxiliary member and the cover comprises an engagement portion to determine relative positions of the discharge auxiliary member and the cover; and a force necessary for disengaging the engagement portions from each other is larger than a force necessary to move the sheet feed cassette from the contracted state to the extended state.

6. The image forming apparatus according to claim 1, further comprising a warning label provided to the cover.

7. The image forming apparatus according to claim 1, wherein the image forming part employs an inkjet recording system.

8. The image forming apparatus according to claim 1, further comprising an extension that is configured to be accommodated within the discharge auxiliary member when the extension is in a retracted state and the extension is configured to be extendable, from the retracted state, in which the extension is not protruding outwardly from the discharge auxiliary member, to an extended state in which the extension, in the extended state, is protruding outwardly from the discharge auxiliary member.

9. The image forming apparatus according to claim 1, further comprising an auxiliary child member that is configured to be extendable, from a retracted state in which the auxiliary child member is not protruding outwardly from the discharge auxiliary member, to an extended state in which the auxiliary child member in the extended state, is protruding outwardly from the discharge auxiliary member, wherein the image forming apparatus includes a nested configuration in which the auxiliary child member in the retracted state is nested within the discharge auxiliary member.

10. The image forming apparatus according to claim 1, wherein in a case that the sheet feed cassette, removed from the image forming apparatus body and with the cover attached thereon, is reinserted in the backward direction into the image forming apparatus body, the discharge auxiliary member slides against the cover in the frontward direction opposite the backward direction of insertion of the sheet feed cassette, to move the discharge auxiliary member to a position to extend the top surface of the discharge tray.

* * * * *